United States Patent [19]

Robinson et al.

[11] Patent Number: 4,876,806

[45] Date of Patent: Oct. 31, 1989

[54] ASYMMETRIC SHOE

[75] Inventors: John R. Robinson, Beaverton; Daniel J. Richard, Portland, both of Oreg.

[73] Assignee: Nike, Inc., Beaverton, Oreg.

[21] Appl. No.: 243,191

[22] Filed: Sep. 8, 1988

Related U.S. Application Data

[63] Continuation of Ser. No. 823,772, Jan. 29, 1986, abandoned.

[51] Int. Cl.[4] ..... A43B 5/00; A43B 23/00; A43B 13/12

[52] U.S. Cl. ..... 36/114; 36/45; 36/30 R; 36/31

[58] Field of Search ..... 36/114, 102, 28, 30 R, 36/31, 32, 45, 50, 92, 80–81; D2/309, 310; 128/584, 585

[56] References Cited

U.S. PATENT DOCUMENTS

| | | | |
|---|---|---|---|
| D.283,364 | 4/1986 | Gamm | D2/309 |
| D. 283,463 | 4/1986 | Chassaing | D2/310 |
| 1,689,260 | 10/1928 | Stroutman | 36/80 |
| 1,778,683 | 10/1930 | Messler | 36/81 |
| 2,572,948 | 10/1951 | Poon | 36/45 |
| 2,733,523 | 2/1956 | Murray | 36/32 R |
| 2,885,797 | 5/1959 | Chrencik | 36/32 R |
| 3,138,880 | 6/1964 | Kinzol | 36/114 |
| 3,345,762 | 10/1967 | Fisher et al. | 36/30 R |
| 3,984,926 | 10/1976 | Calderon | 36/71 |
| 4,128,950 | 12/1978 | Bowerman | 36/30 R |
| 4,255,876 | 3/1981 | Johnson | 36/45 |
| 4,498,251 | 2/1985 | Shin | 36/30 R |
| 4,557,059 | 12/1985 | Misevich et al. | 36/32 R |
| 4,559,723 | 12/1985 | Hamy et al. | 36/102 |
| 4,571,856 | 2/1986 | Lin et al. | 36/114 |
| 4,616,432 | 10/1986 | Bunch et al. | 36/50 |
| 4,622,763 | 11/1986 | Adams | 36/114 |

FOREIGN PATENT DOCUMENTS

| | | | |
|---|---|---|---|
| 2131677 | 6/1984 | United Kingdom | 36/102 |

*Primary Examiner*—Steven N. Meyers
*Attorney, Agent, or Firm*—Banner, Birch, McKie and Beckett

[57] ABSTRACT

The present invention is directed to an asymmetric shoe which provides greater support, proper flexion and a more accurate fit than conventional shoes. The shoe of the present invention structures one or more of the following portions of the shoe upper and sole asymmetrically between the medial and lateral sides. First, a lateral stability strap is positioned immediately posterior of the fifth metatarsal-phalanges joint while a medial stability strap is positioned posterior of the first metatarsal-phalanges joint. Second, a lateral flex notch is aligned with the fifth metatarsal-phalanges joint and a medial flex notch is aligned with the first metatarsal-phalangess joint to allow the shoe to flex along the foot's natural flex line. Third, a medial quarter notch is positioned anterior of a lateral quarter notch to accommodate the difference between the medial and lateral malleolar lengths. The asymmetry of malleolar heights is also accommodated by having a quarter height difference; the medial quarter height being as much as 2.5 cm. higher than the lateral quarter height. Fourth, the anterior edge of a midsole wedge section is aligned immediately posterior of the metatarsal-phalanges joints. Fifth, in a combination lasted shoe the anterior edge of a board is aligned immediately posterior of the metatarsal-phalanges joint.

18 Claims, 4 Drawing Sheets

ASYMMETRIC SHOE

This application is a continuation of application Ser. No. 823,772 filed Jan. 29, 1986, now abandoned.

FIELD OF THE INVENTION

The present invention is directed to a shoe and, more particularly, to a shoe wherein certain portions of the upper and sole are asymmetric in order to provide greater support and more accurate fit for the foot.

BACKGROUND OF THE INVENTION

Most shoes, including athletic shoes, are designed so that the medial side and the lateral side of the shoe are symmetric. However, the anatomy of the foot is not symmetric between the medial and lateral sides. While a symmetric shoe may be more aesthetically pleasing than an asymmetric shoe, it does not properly fit the foot, resticts the natural movement of the foot, and decreases foot stability.

Some asymmetric features have been incorporated into prior art shoes. For example, shoes are often designed with an anatomical arch, a natural lateral curvature in lasts and a natural toe curvature in lasts. However, several areas of misalignment are still found in many current shoes wherein the symmetry of the portions of the shoe detract from its comfort and proper functioning, particularly when the shoe is an athletic shoe. For example, the symmetric placement of stability straps and flex notches in the forepart hinders movement of the lateral metatarsal-phalanges joint. While the medial flex notch and stability strap are respectively aligned directly over and posterior to the medial metatarsal-phalanges joint, the symmetric placement of the lateral flex notch and stability strap locates them respectively anterior and directly over the lateral metatarsal-phalanges joint, causing this hinderance. The generally symmetric placement of the quarter heights and quarter notches in current shoes also fails to contour the upper to the differences between the medial and lateral malleolar height and length. Finally, when the anterior edge of the midsole wedge and the board in a combination lasted shoe extends transversely from posterior of the first metatarsal-phalanges joint to directly under the fourth and fifth metatarsal-phalanges joints, natural foot flexure is inhibited, forefoot valgus is caused and stability may decrease.

SUMMARY OF THE INVENTION

To overcome the above disadvantages resulting from this misalignment, the shoe of the present invention structures one or more portions of the upper and sole asymmetrically between the medial and lateral sides. These asymmetric structures of the shoe include one or more of the following.

First, the lateral stability strap is positioned immediately posterior of the fifth metatarsal-phalanges joint while the medial stability strap is posterior of the first metatarsal-phalanges joint. Second, the lateral flex notch is aligned with the fifth metatarsal-phalanges joint and the medial flex notch is aligned with the first metatarsal-phalanges joint. This placement of the medial and lateral stability straps and flex notches supports the metatarsals without hinderance of plantar and dorsi flexion of the metatarsal-phalanges joints, and thus allows the shoe to flex along the foot's natural flex line.

Third, the medial quarter notch is positioned anterior of the lateral quarter notch so as to align the notch with the malleolar position wherein the medial and lateral malleolar lengths differ. Also, the asymmetry of malleolar heights is accommodated by increasing the quarter height difference to reflect this asymmetry wherein the medial quarter height may be as much as 2.5 cm. higher than the lateral quarter height. The higher medial quarter can increase stability and the asymmetry of the quarter heights and notches can also enhance the perception of comfortable fit of the shoes.

Fourth, the anterior edge of the midsole wedge is aligned posterior of all the metatarsal-phalanges joints.

Fifth, the anterior edge of the board is aligned immediately posterior of all the metatarsal-phalanges joints to follow the backward slant of the metatarsal-phalanges joint line from the medial to the lateral side in a combination lasted shoe. The anterior edge of the midsole wedge is also preferably aligned immediately posterior of all the metatarsal-phalanges joints to follow the backward slant of the metatarsal-phalanges joint line. This alignment of the anterior edge of the midsole wedge and board permits the foot to tread and flex naturally.

DETAILED DESCRIPTION OF THE INVENTION

Figure 1:
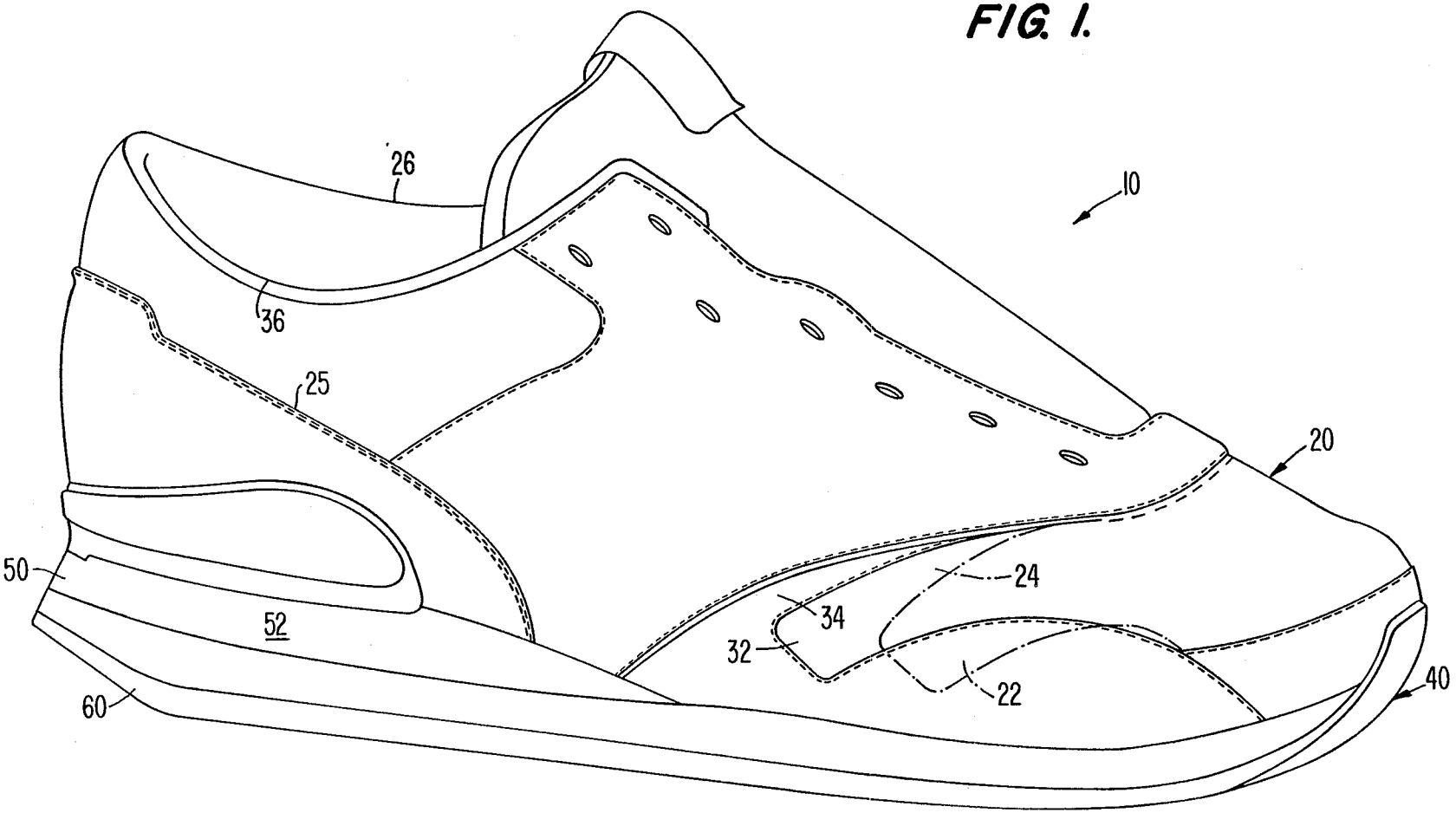
FIG. 1 is a lateral side view of a shoe showing the asymmetric placement of the stability straps, flex notches, quarter heights and quarter notches in accordance with the present invention.

A preferred embodiment of the asymmetric shoe in accordance with the present invention is illustrated in FIG. 1 and generally designated 10. In the figures, like numerals will be used to indicate like elements. Shoe 10 comprises an upper 20 attached to a sole 40. Sole 40 includes a midsole 50 formed of a conventional resilient, shock absorbing material and an outsole 60 formed of a conventional resilient, durable material. Upper 20 is made of at least one layer of material. A medial flex notch 22 (delineated in dot-dash line) is formed in upper 20 on its medial side, and is positioned in the area overlying the first metatarsal-phalanges joint so that it has a border on either side of the first metatarsal-phalanges joint. A lateral flex notch 32 is formed in upper 20 on its lateral side, and is positioned posterior of medial flex notch 22 in the area overlying the fifth metatarsal-phalanges joint so that it has a border on either side of the fifth metatarsal-phalanges joint. The lateral flex notch 32 will be located approximately 3 cm. posterior of the medial flex notch 22 in a Men's size 9 shoe.

Figure 7:
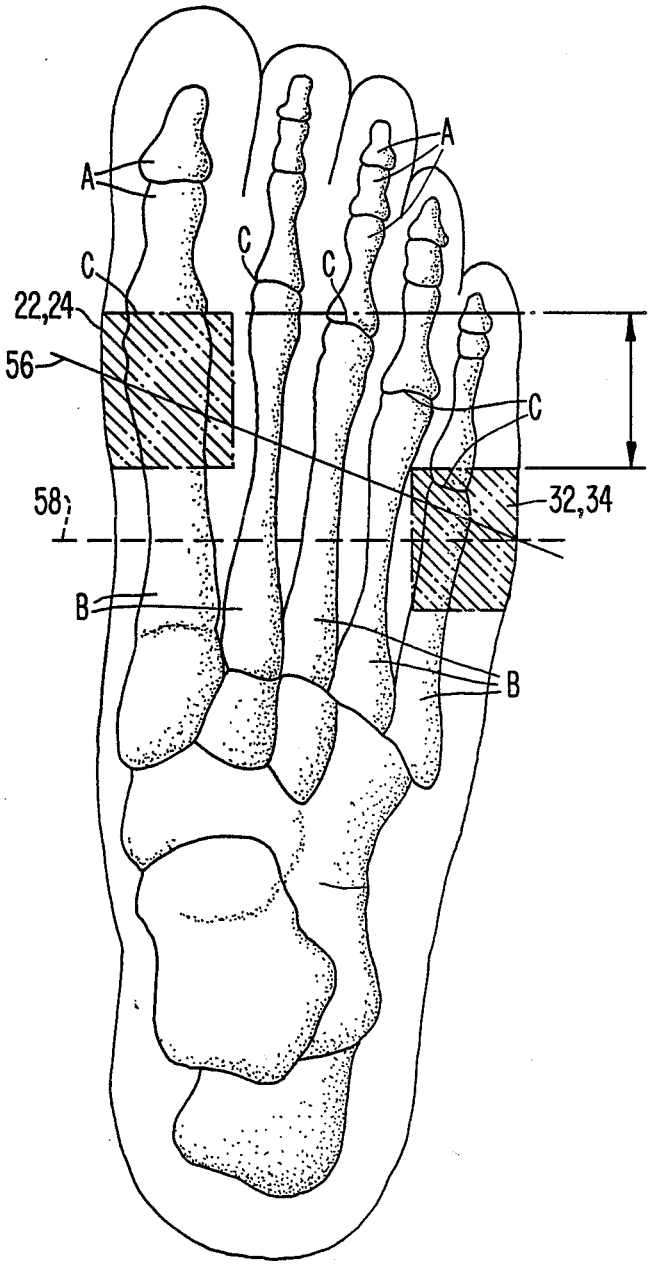
FIG. 7 is a plan view of the foot showing the asymmetric anatomy of the metatarsal-phalanges joints and the position of the stability straps and flex notches in accordance with the present invention.

As shown in FIG. 7, each foot has a total of fourteen phalanges, two on the great toe and three on each of the other toes. The phalanges of the great toe and one other toe are shown at reference letter A. The three phalanges of the other toes are known as the phalanges of the first row, the second row, and the ungual phalanges, respectively, from the foot outward toward the ends of the toes. Each foot also includes five metatarsal bones, one corresponding to each toe. These metatarsal bones are indicated by reference letter B. The metatarsal-phalanges joints, the joint between each metatarsal bone and a respective first row phalanges are shown at C in FIG. 7. The toes and their respective joints are labeled first through fifth, from the great toe toward the smallest toe, respectively.

Flex notches 22 and 32 increase the flexibility of the upper in the area of the notches. In the embodiment illustrated in FIG. 1, upper 20 is illustrated as multi-layered. For example, one or more inner layers of lightweight flexible material surround the foot and, in areas which require additional support or reinforcement, less flexible, sturdier material is attached over the inner layers of material. The lightweight materials could be synthetic, while the sturdier material could be leather. In such a multi-layer upper, flex notches 22 and 32 are formed as cut out areas in the sturdier material so that the lightweight, more flexible material remains in the area of the notches. The sturdier material surrounding medial flex notch 22 thus forms a medial overlay of multi-layered upper 20; and the sturdier material surrounding lateral flex notch 32 thus forms a lateral overlay of multi-layer upper 20. Other techniques for increasing the flexibility of the upper material, such as by scoring, could also be used, particularly if the upper includes only a single layer of material. The asymmetric placement of the flex notches in accordance with this embodiment allows proper plantar and dorsi flexion of the metatarsal-phalanges joint.

Upper 20 also includes a medial stability strap 24 (the forward portion of which is delineated in dot-dash line) located in an area immediately posterior of the first metatarsal-phalanges joint so that it has a forward edge posterior of the first metatarsal-phalanges joint. Also, at least a portion of medial stability strap 24 is located anterior of the fifth metatarsal-phalanges joint. A lateral stability strap 34 is located in an area immediately posterior of the fifth metatarsal-phalanges joint so that it has its forward edge posterior of the fifth metatarsal-phalanges joint. This can be accomplished by moving lateral stability strap 34 posteriorly approximately 3 cm. of the medial stability strap in a Men's size 9 shoe. Stability straps 24, 34 in the multi-layered upper of FIG. 1 are formed of a relatively sturdy, non-stretch overlay material mentioned above, i.e., sturdier and less-stretchable than the material outside the immediate area of the stability straps. The stability straps are located so as to provide support for the metatarsal bones. The asymmetric placement of the stability straps posterior of the adjacent metatarsal-phalanges joints assures that the support is provided without hindering movement of the joints. The positioning of the flex notches 22, 32 and stability straps 24, 34 with respect to the bones of the foot is illustrated diagramatically by the shaded blocks in FIG. 7.

Figure 2:
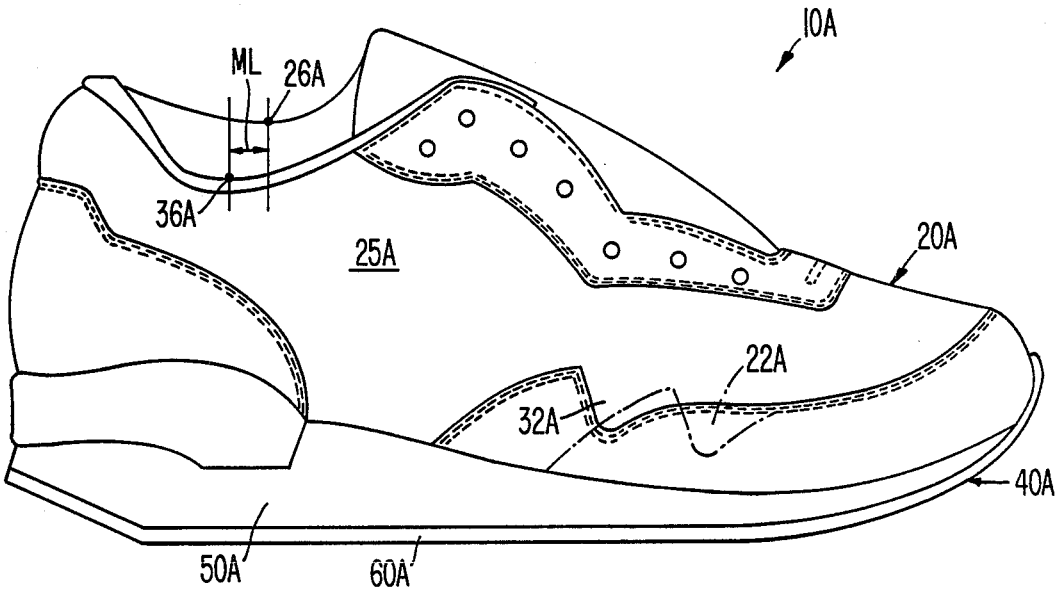
FIG. 2 is a lateral side view of a shoe showing the asymmetric placement of the flex notches, quarter heights and quarter notches.

FIG. 2 illustrates a shoe 10A in accordance with the present invention which includes flex notches but not stability straps. A medial flex notch 22A (delineated in dot-dash line) is formed in a sturdy material overlay of multi-layered upper 20A which surrounds the toe and the medial and lateral sides of the forepart of the upper. Likewise a lateral flex notch 32A is formed in the sturdy material overlay of multi-layered upper 20A. Medial flex notch 22A is positioned in the area overlying the first metatarsal-phalanges joint and lateral flex notch 32A is positioned in the area overlying the fifth metatarsal-phalanges joint.

Figure 3:
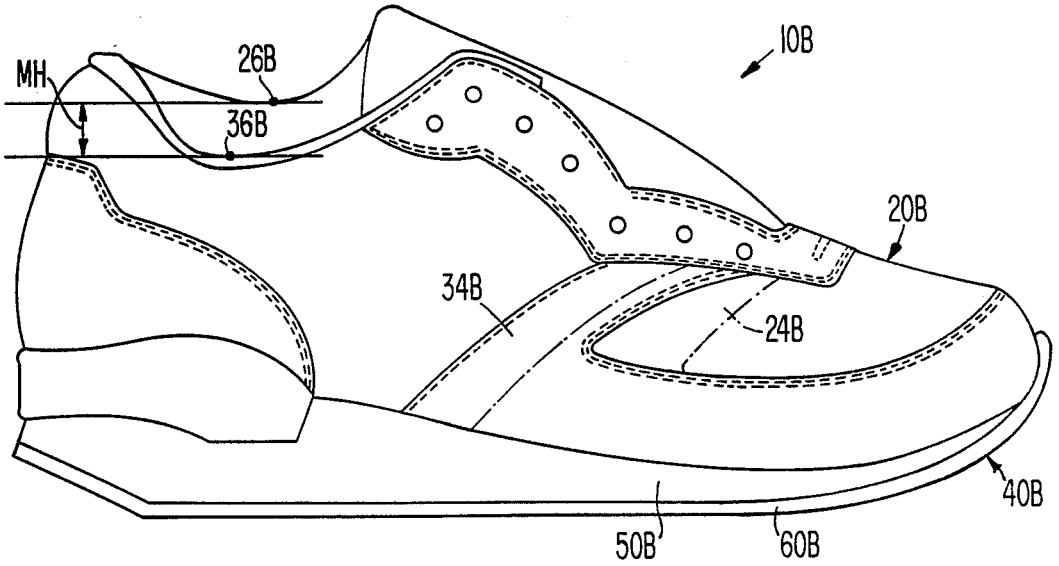
FIG. 3 is a lateral side view showing the asymmetric placement of the stability straps, quarter heights and quarter notches.

FIG. 3 illustrates a shoe 10B in accordance with the present invention which includes stability straps but not flex notches. A medial stability strap 24B is formed of a sturdy non-stretch material overlay of multi-layered upper 20B. A lateral stability strap 34B is likewise formed of a sturdy, non-stretch material overlay of multi-layered upper 20B. Medial stability strap 24B is located in an area immediately posterior of the first metatarsal-phalanges joint, and lateral stability strap 34B is located in an area immediately posterior of the fifth metatarsal-phalanges joint.

Figure 4:
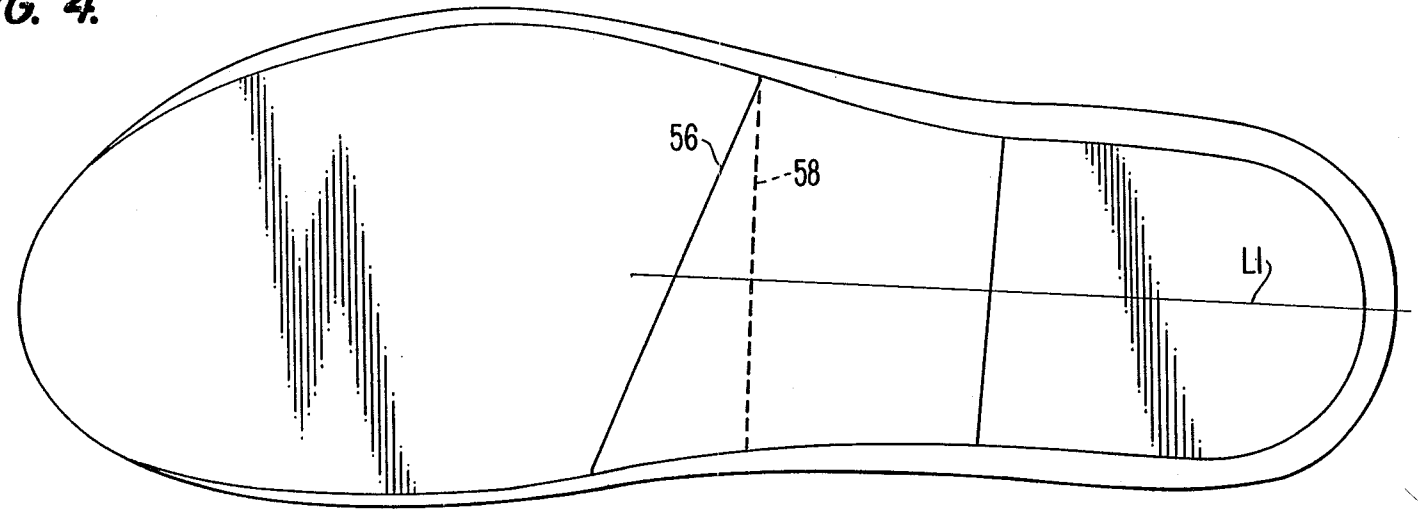
FIG. 4 is a top plan view showing the asymmetric front edge of the midsole wedge and board.
Figure 5:
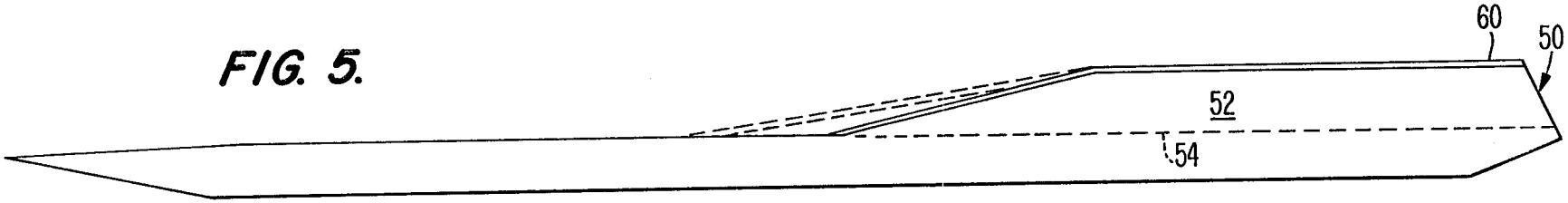
FIG. 5 is a lateral side view showing the asymmetric midsole wedge and board.
Figure 6:
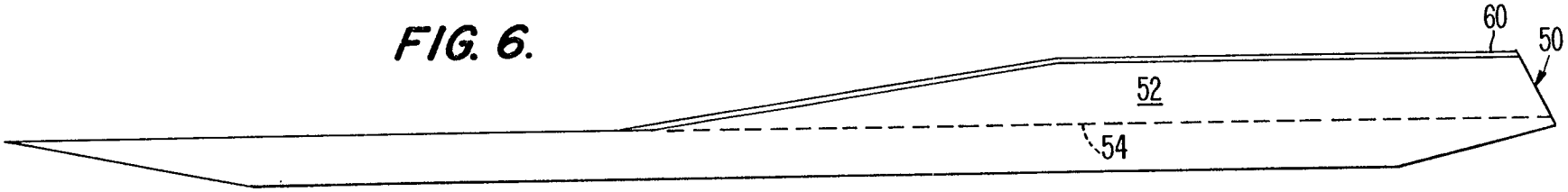
FIG. 6 is a medial side view showing the asymmetric midsole wedge and board.

FIGS. 4, 5 and 6, illustrate a midsole layer 50 of sole 40 and a board 60, which is used when the shoe is a combination lasted shoe. Midsole 50 includes a wedge section 52 which increases the thickness of the midsole in the area generally between the metatarsal-phalanges joints and the heel. Midsole 50 is preferably formed in a single integral piece of material and wedge section 52 is delineated by dash line 54 and the upper surface of midsole 50. Alternatively, wedge section 52 could be made of a separate piece of material such as shown in FIG. 1. The anterior edge 56 of wedge section 52 on the medial side of the sole is located immediately posterior of the first metatarsal-phalanges joint, and on the lateral side of the sole is located posterior of both the medial side anterior edge and the fifth metatarsal-phalanges joint. In this way, the flexibility of the shoe in the area of the metatarsal-phalanges joints is greatly enhanced. In a combination lasted shoe the anterior edge of board 60 is coexistensive with anterior edge 56 of wedge section 54. As shown in dash line 58 in FIG. 4 the anterior edge of wedge section 52 could alternatively extend generally perpendicularly of a rear part bisecting line L-1, as long as the anterior edge is located posterior of both the first and fifth metatarsal-phalanges joints. FIG. 7 also illustrates the location of the anterior edges with references lines 56 and 58.

FIGS. 1, 2 and 3 illustrate another aspect of an asymmetric shoe in accordance with the invention. Upper 20, 20A, 20B, which is formed of at least one layer of material, defines a quarter portion 25, 25A, 25B in the rear-part section with an ankle opening. The lowest point of the ankle opening on the medial side is referred to herein as the medial quarter notch 26, 26A, 26B. The lowest point of the ankle opening on the lateral side is referred to herein as the lateral quarter notch 36, 36A, 36B. Medial quarter notch 26, 26A, 26B is located anterior of lateral quarter notch 36, 36A, 36B by a distance approximately equal to the difference between medial and lateral malleolar lengths, i.e., the distance from the posterior point of the heel to the center of the malleolar protuberance on either side of the foot (ML in FIG. 2). This distance typically equals 2 cm in an adult. In this way, comfort and stability are enhanced.

As further seen in FIGS. 1, 2 and 3, the asymmetry of medial and lateral quarter heights i.e., the height or top edge of the ankle opening in quarter portion 25, accommodates the difference in malleolar heights on the medial and lateral sides, i.e., the distance from the floor to the malleolar protuberance on either side of the foot (MH in FIG. 3). The medial quarter height may be as much as 2.5 cm greater than the lateral quarter height in a Men's size 9 shoe.

An asymmetric shoe in accordance with the invention can be made with any one of the asymmetric structural elements of the upper and sole or any combination thereof. The particular combination of elements will depend upon the intended use, the requirements of the intended user and the like.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent intended by the broad generally meaning of the terms in which the appended claims are expressed.

We claim:

1. An asymmetric shoe having a forepart section and a rearpart section comprising:

an upper;

a sole attached to said upper;

said upper being formed of a plurality of layers of material including an inner layer and an outer layer, said outer layer including a medial overlay in the area of the first metatarsal-phalanges joint and a lateral overlay in the area of the fifth metatarsal-phalanges joint, said medial and lateral overlays having medial and lateral flex notches for enhancing the flexibility of the material in the area of said notches, said medial flex notch extending over the area overlying and having a border on either side of the first metatarsal-phalanges joint, said lateral flex notch extending posterior of said medial flex notch to the area overlying the fifth metatarsal-phalanges joint and having a border on either side of the fifth metatarsal-phalanges joints, at least one of said layers of material defining a quarter portion with an ankle opening in the rearpart section, said quarter portion at said ankle opening having a greater height on the medial side than on the lateral side by a distance approximately equal to an average difference between the medial and lateral malleolar heights, the lowest point of the ankle opening in said quarter portion on the medial side being located anterior of the lowest point of the ankle opening in said quarter portion on the lateral side by a distance approximately equal to the difference between the medial and lateral malleolar lengths;

said sole including a midsole with a wedge section increasing the thickness of the midsole in the area generally between the metatarsal-phalanges joints and the heel, the anterior edge of said wedge section on the medial side of the sole being located posterior of the first metatarsal-phalanges joint and on the lateral side being located posterior of the fifth metatarsal-phalanges joint.

2. An asymmetric shoe in accordance with claim 1 wherein said layers of upper material in the forepart section include medial and lateral stability straps of relatively sturdy, non-stretch material to hold the metatarsal bones in position in the shoe, said medial stability strap having its forward edge located posterior of the first metatarsal-phalanges joint, and said lateral stability strap having its forward edge located posterior of the fifth metatarsal-phalanges joint.

3. An asymmetric shoe in accordance with claim 1 wherein said shoe is combination lasted with a board extending over a portion of the length of the shoe, said board having an anterior edge on the medial side located posterior of the first metatarsal-phalanges joint and on the lateral side posterior of the fifth metatarsal-phalanges joint.

4. An asymmetric shoe having a forepart section and rearpart section comprising:

an upper;

a sole attached to said upper;

said upper being formed of a plurality of layers of material including an inner layer and an outer layer, said outer layer including a medial overlay in the area of the first metatarsal-phalanges joint and a lateral overlay in the area of the fifth metatarsal-phalanges joint, said medial and lateral overlays having medial and lateral flex notches for enhancing the flexibility of the material in the area of said notches, said medial flex notch being formed over the area overlying the first metatarsal-phalanges joint and having a border on either side of the first metatarsal phalanges joint, said lateral flex notch being formed posterior of said medial flex notch over the area overlying the fifth metatarsal-phalanges joint and having a border on either side of the fifth metatarsal-phalanges joint, said layers of upper material in the forepart section including medial and lateral stability straps of relatively sturdy, non-stretch material, said medial stability strap having its forward edge located posterior of the first metatarsal-phalanges joint, and said lateral stability strap having its forward edge located posterior of the fifth metatarsal-phalanges joint whereby said straps support the metatarsal bones in position in the shoe without hindering the plantar and dorsi flexion of the metatarsal-phalanges joints.

5. An asymmetric shoe in accordance with claim 4 wherein at least one of said layers of upper material in the rearpart section define a quarter portion with an ankle opening, said quarter portion at said ankle opening having a greater height on the medial side than on the lateral side by a distance approximately equal to an average difference between the medial and lateral malleolar heights, the lowest point of the ankle opening in said quarter portion on the medial side being located anterior of the lowest point of the ankle opening in said quarter portion on the lateral side by a distance approximately equal to the distance between the medial and lateral malleolar lengths whereby comfort and stability are enhanced.

6. An asymmetric shoe in accordance with claim 4 wherein said sole includes a shock absorbing midsole with a wedge section increasing the thickness of the midsole in the area generally between the metatarsal-phalanges joints and the heel, the anterior edge of said wedge section on the medial side of the sole being located posterior of the first metatarsal-phalanges joint and on the lateral side being located posterior of the fifth metatarsal-phalanges joint to enhance the flexibility of the shoe along the area of the metatarsal-phalanges joints.

7. An asymmetric shoe in accordance with claim 6 wherein said shoe is combination lasted with a board extending over a portion of the length of the shoe, said board having an anterior edge on the medial side located posterior of the first metatarsal-phalanges joint and on the lateral side posterior of the fifth metatarsal-phalanges joint.

8. An asymmetric shoe having a forepart section and rearpart section comprising:

an upper;

a sole attached to said upper;

said upper being formed of a plurality of layers of material including an inner layer and an outer layer said outer layer including a medial overlay in the area of the first metatarsal-phalanges joint and a lateral overlay in the area of the fifth metatarsal-phalanges joint, said medial and lateral overlays having medial and lateral flex notches for enhancing the flexibility of the material in the area of said notches, said medial flex notch being formed over the area overlying the first metatarsal-phalanges joint and having a border on either side of the first metatarsal phalanges joint, said lateral flex notch being formed posterior of said medial flex notch over the area overlying the fifth metatarsal-phalanges joint and having a border on either side of the fifth metatarsal-phalanges joint.

9. An asymmetric shoe in accordance with 8 wherein at least one of said layers of material defines a quarter portion, said quarter portion at said ankle opening having a greater height on the medial side than on the lateral side by a distance approximately equal to an average difference between the medial and lateral malleolar heights.

10. An asymmetric shoe in accordance with claim 8 wherein said sole includes a shock absorbing midsole with a wedge section increasing the thickness of the midsole in the area generally between the metatarsal-phalanges joints and the heel, the anterior edge of said wedge section on the medial side of the sole being located posterior of the first metatarsal-phalanges joint and on the lateral side being located posterior of both the medial side anterior edge and the fifth metatarsal-phalanges joint to enhance the flexibility of the shoe along the area of the metatarsal-phalanges joints.

11. An asymmetric shoe in accordance with claim 10 wherein said shoe is combination lasted with a board extending over a portion of the length of the shoe, said board having an anterior edge on the medial side located posterior of the first metatarsal-phalanges joint and on the lateral side posterior of the fifth metatarsal-phalanges joint.

12. An asymmetric shoe having a forepart section and a rearpart section comprising:

an upper;

a sole attached to said upper;

said upper including a plurality of layers of upper material, said layers of material in the forepart section including medial and lateral stability straps of relatively sturdy, non-stretch material to hold the metatarsal bones in position in the shoe, said medial stability strap having its forward edge located posterior of the first metatarsal-phalanges joint, at least a portion of said medial stability strap being located anterior of the fifth metatarsal-phalanges joint, and said lateral stability strap having its forward edge located posterior of the fifth metatarsal-phalanges joint.

13. An asymmetric shoe in accordance with claim 12 wherein at least one layer of said layers of upper material in the rearpart section define a quarter portion with an ankle opening, said quarter portion at said ankle opening having a greater height on the medial side than on the lateral side by a distance approximately equal to an average difference between the medial and lateral malleolar heights, the lowest point of the ankle opening in said quarter portion on the medial side being located anterior of the lowest point of the ankle opening in said quarter portion on the lateral side by a distance approximately equal to the distance between the medial and lateral malleolar lengths whereby comfort and stability are enhanced.

14. An asymmetric shoe in accordance with claim 12 wherein said sole includes a shock absorbing midsole with a wedge section increasing the thickness of the midsole in the area generally between the metatarsal-phalanges joints and the heel, the anterior edge of said wedge section on the medial side of the sole being located posterior of the first metatarsal-phalanges joint and on the lateral side being located posterior of both the medial side anterior edge and the fifth metatarsal-phalanges joint to enhance the flexibility of the shoe along the area of the metatarsal-phalanges joints.

15. An asymmetric shoe in accordance with claim 14 wherein said shoe is combination lasted with a board extending over a portion of the length of the shoe, said board having an anterior edge on the medial side located posterior of the first metatarsal-phalanges joint and on the lateral side posterior of the fifth metatarsal-phalanges joint.

16. An asymmetric shoe in accordance with claim 14 wherein at least one layer of said layers of upper material in the rearpart section define a quarter portion with an ankle opening, said quarter portion at said ankle opening having a greater height on the medial side than on the lateral side by a distance approximately equal to an average difference between the medial and lateral malleolar heights, the lowest point of the ankle opening in said quarter portion on the medial side being located anterior of the lowest point of the ankle opening in said quarter portion on the lateral side by a distance approximately equal to the distance between the medial and lateral malleolar lengths whereby comfort and stability are enhanced.

17. An asymmetric shoe having a forepart section and a rearpart section comprising:

an upper;

a sole attached to said upper, said sole including a shock absorbing midsole with a wedge section increasing the thickness of the midsole in the area generally between the metatarsal-phalanges joints and the heel, the anterior edge of said wedge section on the medial side of the sole being located posterior of the first metatarsal-phalanges joint and on the lateral side being located posterior of the fifth metatarsal-phalanges joint to enhance the flexibility of the shoe along the area of the metatarsal-phalanges joints;

said upper being formed of at least one layer of material having medial and lateral flex notches in the forepart section for enhancing the flexibility of the material in the area of said notches, said medial flex notch being formed over the area overlying the first metatarsal-phalanges joint, said lateral flex notch being formed posterior of said medial flex notch over the area overlying the fifth metatarsal-phalanges joint; and said shoe being combination lasted with a board extending over a portion of the length of the shoe, said board having an anterior edge on the medial side located posterior of the first metatarsal-phalanges joint and on the lateral side posterior of the fifth metatarsal-phalanges joint, and the anterior edge of said midsole wedge section on the lateral side being located posterior of the medial side anterior edge of said wedge section.

18. An asymmetric shoe having a forepart section and a rearpart section comprising:

an upper;

a sole attached to said upper;

said sole including a shock absorbing midsole with a wedge section increasing the thickness of the midsole in the area generally between the metatarsal-phalanges joints and the heel, the anterior edge of said wedge section on the medial side of the sole being located posterior of the first metatarsal-phalanges joint and on the lateral side being located posterior of both the medial side anterior edge and the fifth metatarsal-phalanges joint to enhance the flexibility of the shoe along the area of the metatarsal-phalanges joints, said shoe being combination lasted with a board extending over a portion of the length of the shoe, said board having an anterior edge on the medial side located posterior of the first metatarsal-phalanges joint and on the lateral side posterior of the fifth metatarsal-phalanges joint.

* * * * *